US007338084B1

(12) United States Patent
Ahn

(10) Patent No.: US 7,338,084 B1
(45) Date of Patent: Mar. 4, 2008

(54) PAGE SKIPPING BOOK

(76) Inventor: Jihyun Ahn, 510 W. Bemont Ave. # 1410, Chicago, IL (US) 60657

( * ) Notice: Subject to any disclaimer, the term of this patent is extended or adjusted under 35 U.S.C. 154(b) by 0 days.

(21) Appl. No.: 10/679,463

(22) Filed: Oct. 7, 2003

(51) Int. Cl.
*B42F 21/00* (2006.01)

(52) U.S. Cl. ..... 283/36; 283/37; 283/38; 283/41

(58) Field of Classification Search ..... 283/36, 283/37, 38, 41; 116/234; 40/359, 641
See application file for complete search history.

(56) References Cited

U.S. PATENT DOCUMENTS

| | | | | |
|---|---|---|---|---|
| 1,337,835 | A * | 4/1920 | Frank | 283/117 |
| 4,184,699 | A * | 1/1980 | Lowe, Jr. | 281/41 |
| 4,291,900 | A * | 9/1981 | Feng | 281/15.1 |
| 4,523,775 | A * | 6/1985 | Reist | 283/36 |
| 4,877,269 | A * | 10/1989 | Callaghan et al. | 283/40 |
| 5,106,097 | A * | 4/1992 | Levine | 273/237 |
| 2003/0214128 | A1* | 11/2003 | Roberts et al. | 281/31 |
| 2004/0056474 | A1* | 3/2004 | Alon et al. | 283/36 |
| 2005/0042583 | A1* | 2/2005 | Barker | 434/159 |
| 2006/0131867 | A1* | 6/2006 | Carmichael et al. | 281/15.1 |

FOREIGN PATENT DOCUMENTS

| | | | |
|---|---|---|---|
| CH | 393257 | * | 10/1965 |
| CH | 620641 | A5 * | 10/1977 |
| FR | 2689816 | A1 * | 10/1993 |
| GB | 413243 | * | 7/1934 |

* cited by examiner

*Primary Examiner*—Dana Ross
(74) *Attorney, Agent, or Firm*—Wood, Phillips, Katz, Clark & Mortimer

(57) ABSTRACT

The present invention is a book made of plural inner sheets with specific cutouts at specific locations at the open margin edge. Each sheet is colored or printed with different animal characters or graphic elements. The sheets are arranged and bound in such a way that when an user flips through this invention at specific location of the open edge, only specific pages after another are viewed. The specific pages are all designed with the same specific colors or the same graphic elements depending on which location of the open edge the user holds to flip through the pages. The appearance of the book changes by the user trying out different locations for flipping the edge.

13 Claims, 12 Drawing Sheets

PAGE SKIPPING BOOK

BACKGROUND OF THE INVENTION

1. Field of the Invention

The present invention relates to books, particularly a book/notebook with entertainment features and versatile functions for young people.

2. Background Art

It is often difficult to attract young people to their studies and make them open their study books. In the prior art, several notebooks have been created, covered with graphics and colorful characters providing eye-catching effects to interest young people and attract them to study. Over repeated uses however, the colorful characters or graphics used in the prior art lose their excitement due to increasing familiarity. While creating fun effects, a magic-like feature built into the structure of a book can vary the appearance of itself at each time of use and thus maintain the fun and novelty for long period of time, while adding versatility to applied uses.

BRIEF SUMMARY OF THE INVENTION

One object of the book according to the present invention is to create a magic-like effect only to be seen by a user. Flipping the pages within the invention creates curiosity and excitement to attract young people to their studies while adding versatility in the book's/notebook's application.

The book of the present invention is constructed with multiple sheets of several repeating characters and graphics. The book has four (4) specific types of composing sheets, each with its unbound (open) side margin cut out at different locations. Typically only one kind of graphic or character appears at one type of sheet with one type of cutout. The varying cutouts provide the user with three different positions (upper corner, middle and lower corner) to flip through the open side of the book. Grabbing the bound edge of the book with one hand and simultaneously flipping the open side with the other hand held at one of the three positions, a user of the notebook repeatedly skips to only the sheets with the identical margin cut, allowing the pages to create a specific theme unique to those sheets. The next pages that the user sees when he or she uses the upper corner to flip the notebook is different from the next pages appearing while the user holds the middle or lower corner to flip the notebook. Using the upper corner, the middle, and the lower corner makes the appearing next pages different at each time from each other. This result creates illusions and magical effects, and maintains curiosity and fun among the users using the invention. Several groups of different pages identified with different graphics or characters in the book provide a variety of applications to this present invention. By this variety and versatility, the invention aims to maintain the utilization among the users, while helping them in studies and other tasks of every day life.

BRIEF DESCRIPTION OF THE SEVERAL VIEWS OF THE DRAWINGS

The present invention may be more fully understood through reference of the following drawings included in the DRAWINGS section. See the "List of Reference Numerals" at front part of the DRAWINGS section for each numeral used in the attached drawings.

Figure 1:
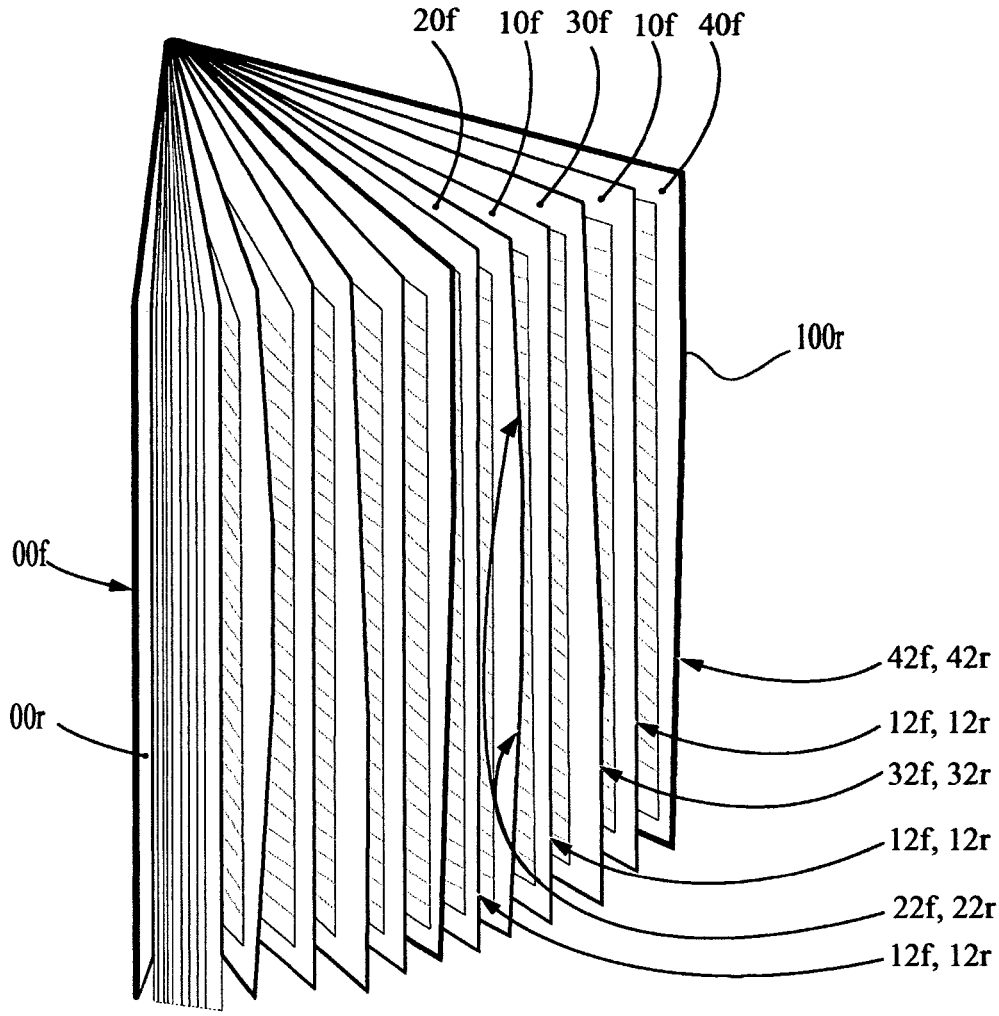
FIG. 1 is a perspective view of the present invention.

See the following "DETAILED DESCRIPTION OF THE INVENTION" to find out how these drawings are used to explain the invention.

DETAILED DESCRIPTION OF THE INVENTION

The present invention is about making a novelty book/notebook with magic-like entertainment features, providing mysterious effects and versatile functions to attract young people and to maintain their interest in using this invention. The flexibility and the interactivity built into the structure of the invention facilitate users to customize and personalize this book, while the creative potential of the young users are developing during this process.

The book/notebook of the present invention is made with a plurality of sheets with different types of related graphic material, that may be different images/elements, such as characters, or colors, with a specific arrangement within the book. A representative book has a squared outer peripheral edge shape. In the embodiment shown, there are four (4) different types of material on the sheets, identified as Type A, Type B, and Type C, Type D. Within the plurality of sheets making up the book are a plurality of sheets of each Type (A-D). The multiple sheets of each type make up a set, with there being four such sets in this particular book corresponding to Types A-D. Each of the representative four (4) types of sheets making up the contents of the book has an open side edge portion cut out in a unique shape, which is different with ordinary fashion from the other types of the sheets and then bound together in a specific order. The graphic images/elements and/or colors of the opening page change by reason of changing the particular engagement location on the peripheral edge at which the user's flipping hand is placed at (representative first, second and third different engagement locations are shown at the upper corner, middle and lower corner of the peripheral edge).

The drawings about to be referred to only display an example of how the present invention may be carried out in an actual produced form. The design of graphic images/elements, the design of cutouts, and the number of composing inner sheets illustrated in the DRAWINGS and explained in the DETAILED DESCRIPTION OF THE INVENTION describe examples from many executed forms of the present invention. While a particular form of the present invention is illustrated and described, it will be apparent that various modifications may be made without departing from the spirit and the scope of the invention. The present invention is intended to include all such modifications insofar as they are produced within the scope of the claims in the attached CLAIM OR CLAIMS or the equivalents thereof.

FIG. 1 represents overall exterior shape of the inventive book in open position via perspective view. In the drawing, each front side/surface of five inner sheets and cutout is labeled with a corresponding numeral to be explained in the continuing drawings. Each sheet has a front surface designated with an "f" suffix and a rear surface designated with an "r" suffix. The sheets are held together using any type of conventional binding that maintains a stacked arrangement of a plurality of intermediate sheets between a front cover/sheet and a rear cover/sheet. The rear/back sides/surfaces of these five sheets along with the remaining pages of the present invention are not called out for sake of clarity.

The four different types of sheets, each produced in multiple number, are used as the inner sheets of the book. The sheets in the set of sheets of each type have related types of material thereon. The material in each of the types is different, each from the other. Each inner sheet of Type A (10*f*, 10*r*), Type B (20*f*, 20*r*), Type C (30*f*, 30*r*), and Type D (40*f*, 40*r*) has a different shape resulting from a different cutout. What makes the sheets of these types different from each other is the location and shape of the cutouts made into the side margin of each sheet.

Figure 2:
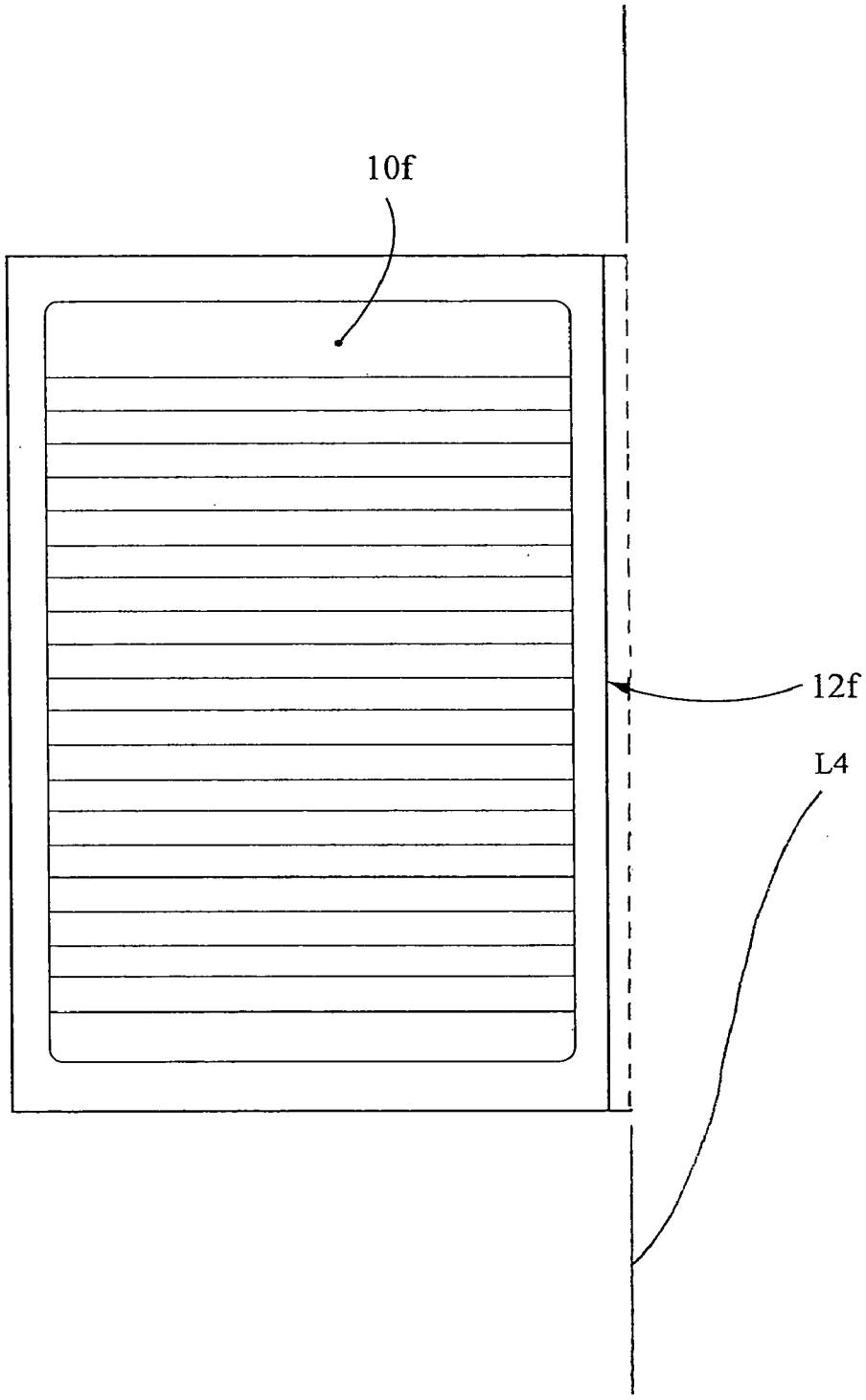
FIG. 2 is a plan view of the Front side of Type A sheet with designations for the front side and cutout part.
Figure 3:
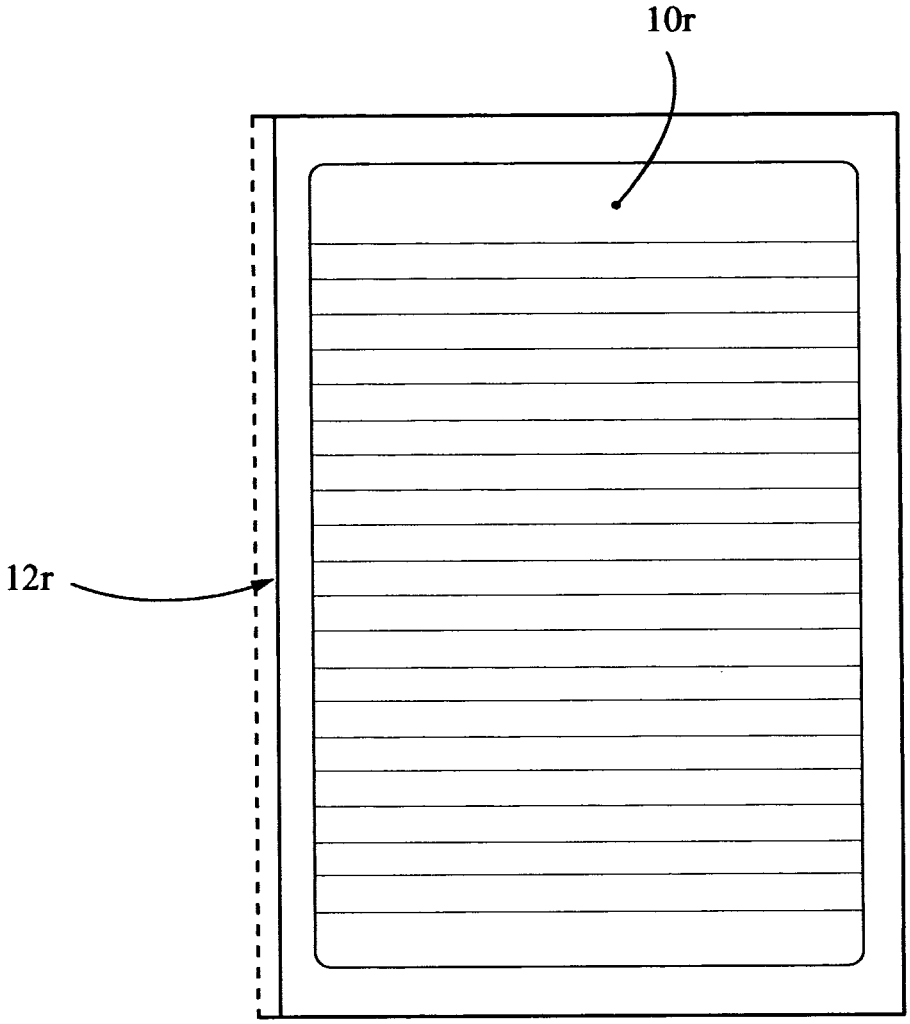
FIG. 3 is a plan view of the Rear side of Type A sheet with designations for the front side and cutout part.
Figure 4:
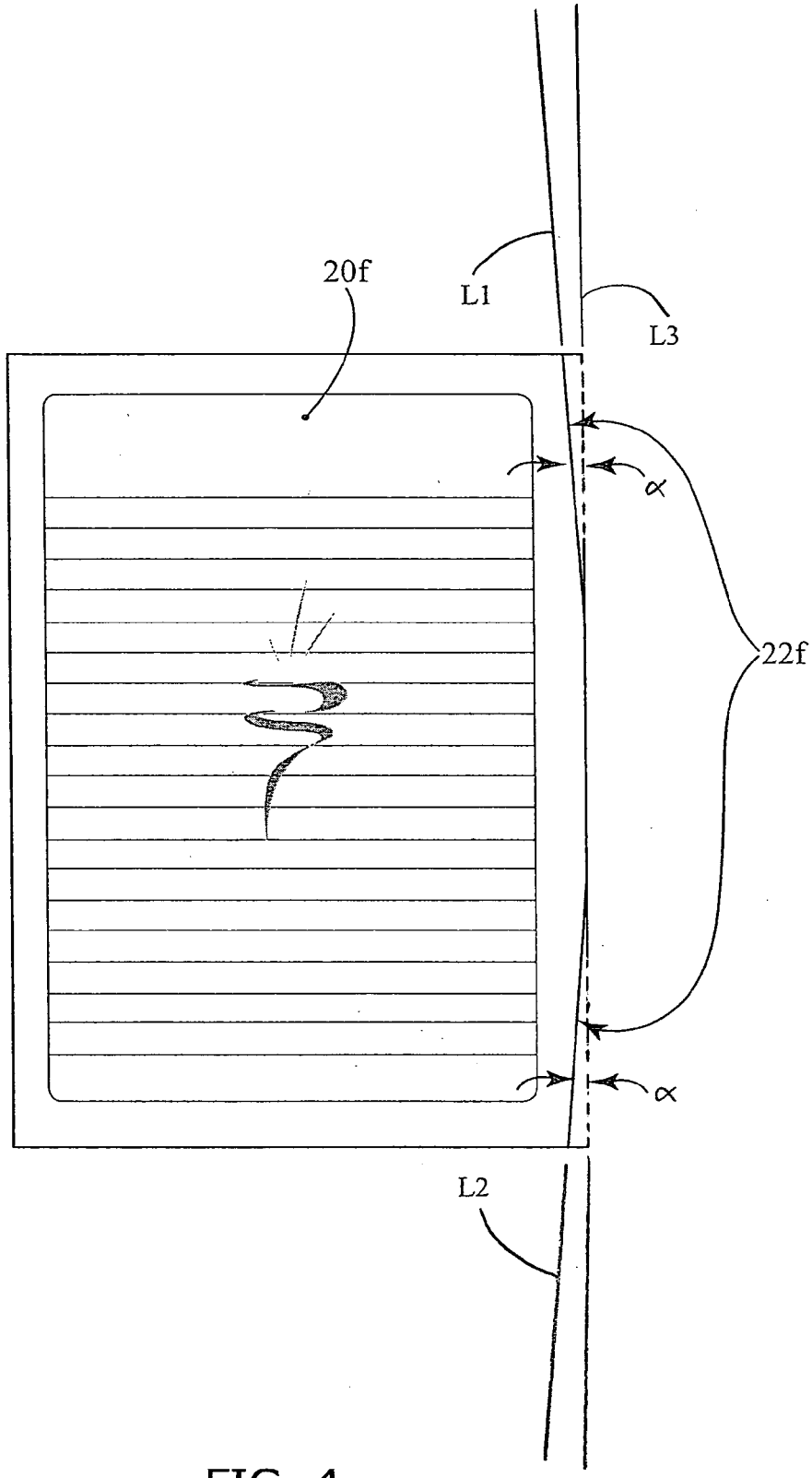
FIG. 4 is a plan view of the Front side of Type B sheet with designations for the front side and cutout part.
Figure 5:
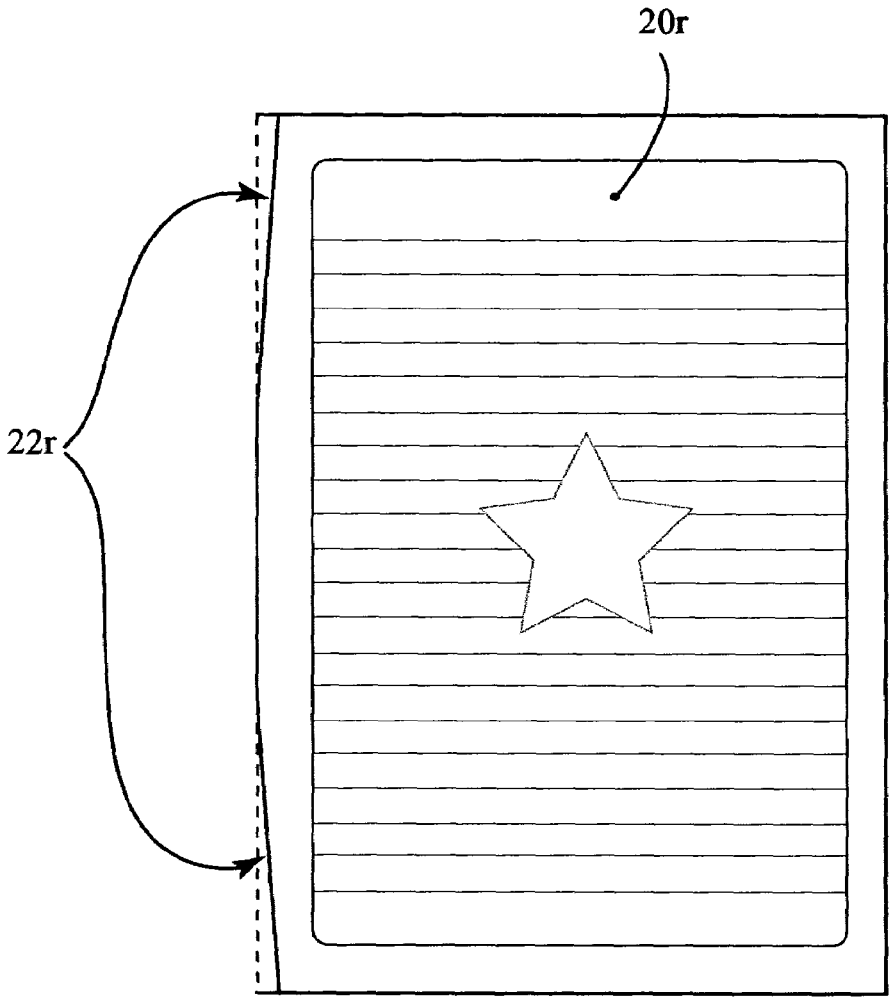
FIG. 5 is a plan view of the Rear side of Type B sheet with designations for the front side and cutout part.
Figure 6:
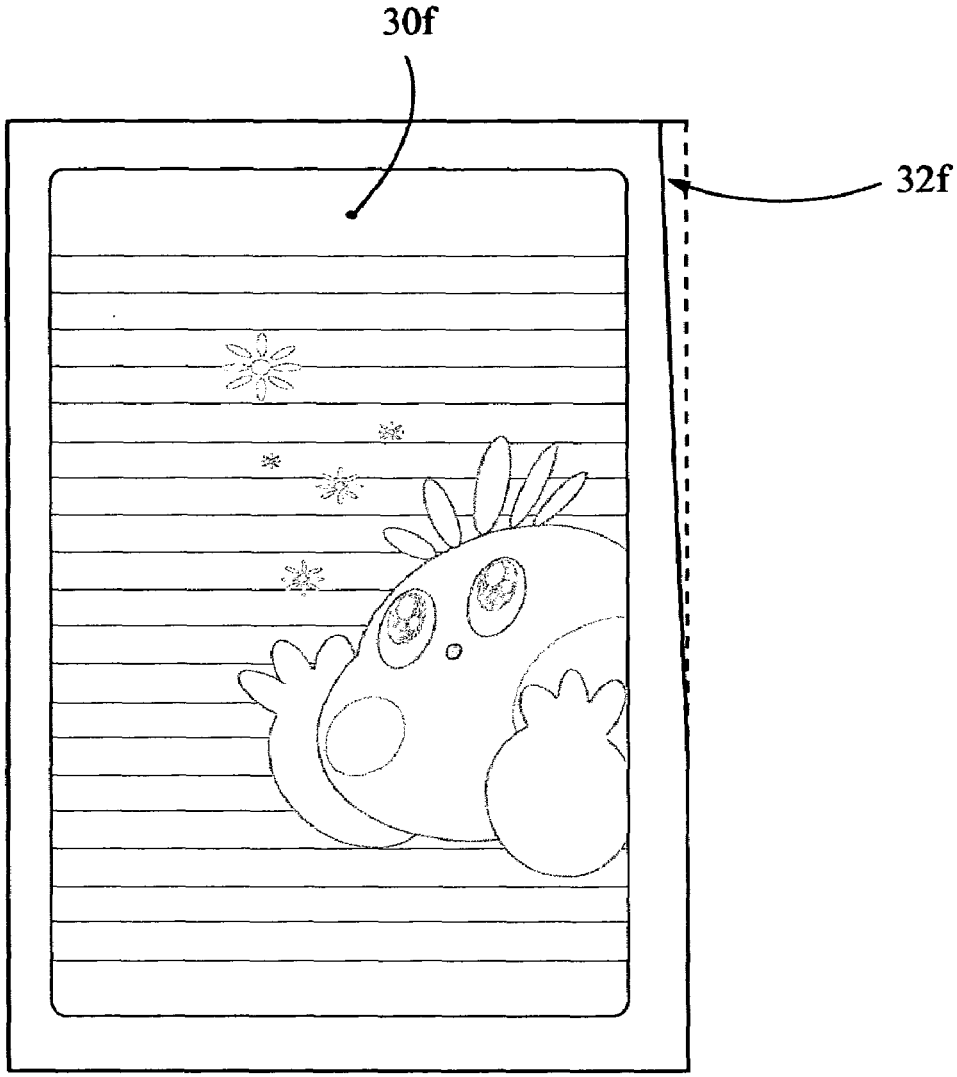
FIG. 6 is a plan view of the Front side of Type C sheet with designations for the front side and cutout part.
Figure 7:
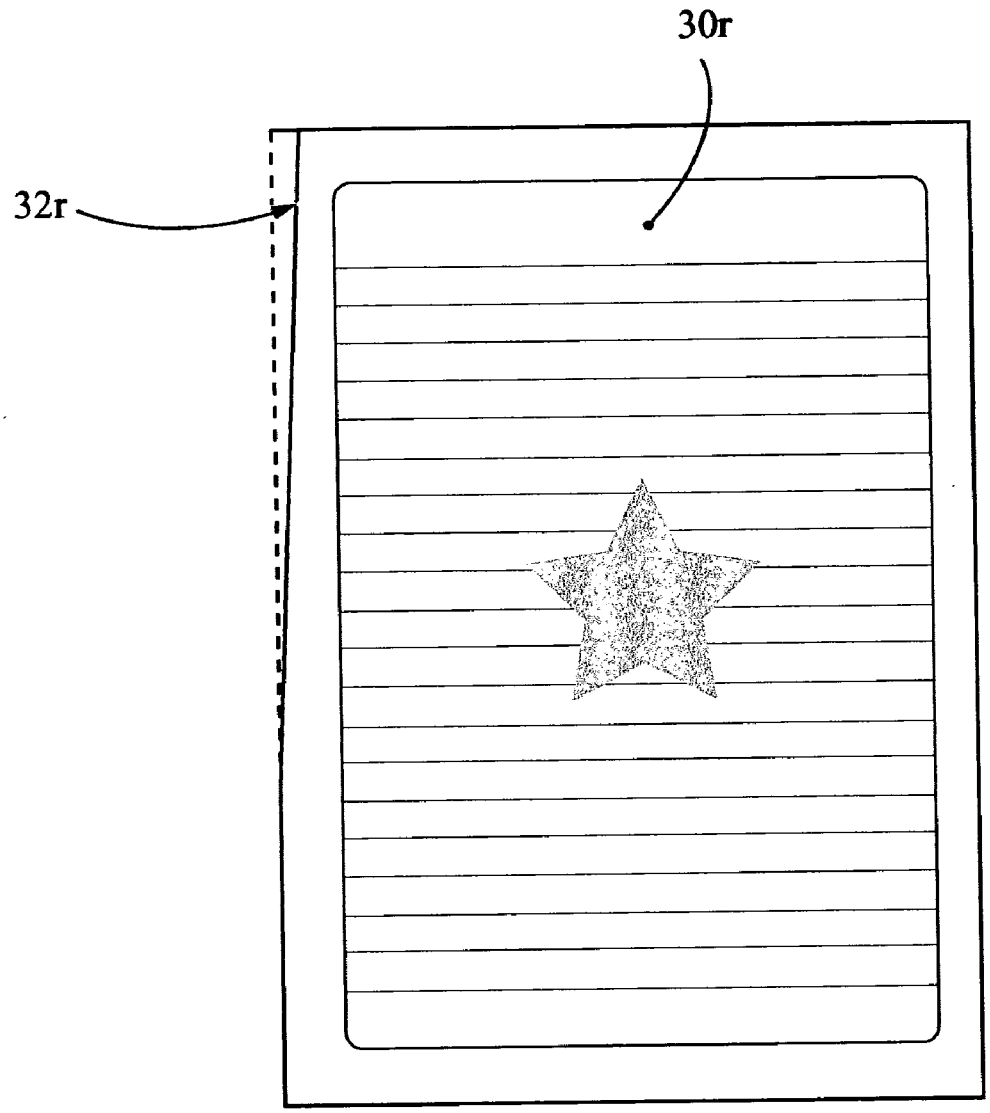
FIG. 7 is a plan view of the Rear side of Type C sheet with designations for the front side and cutout part.
Figure 8:
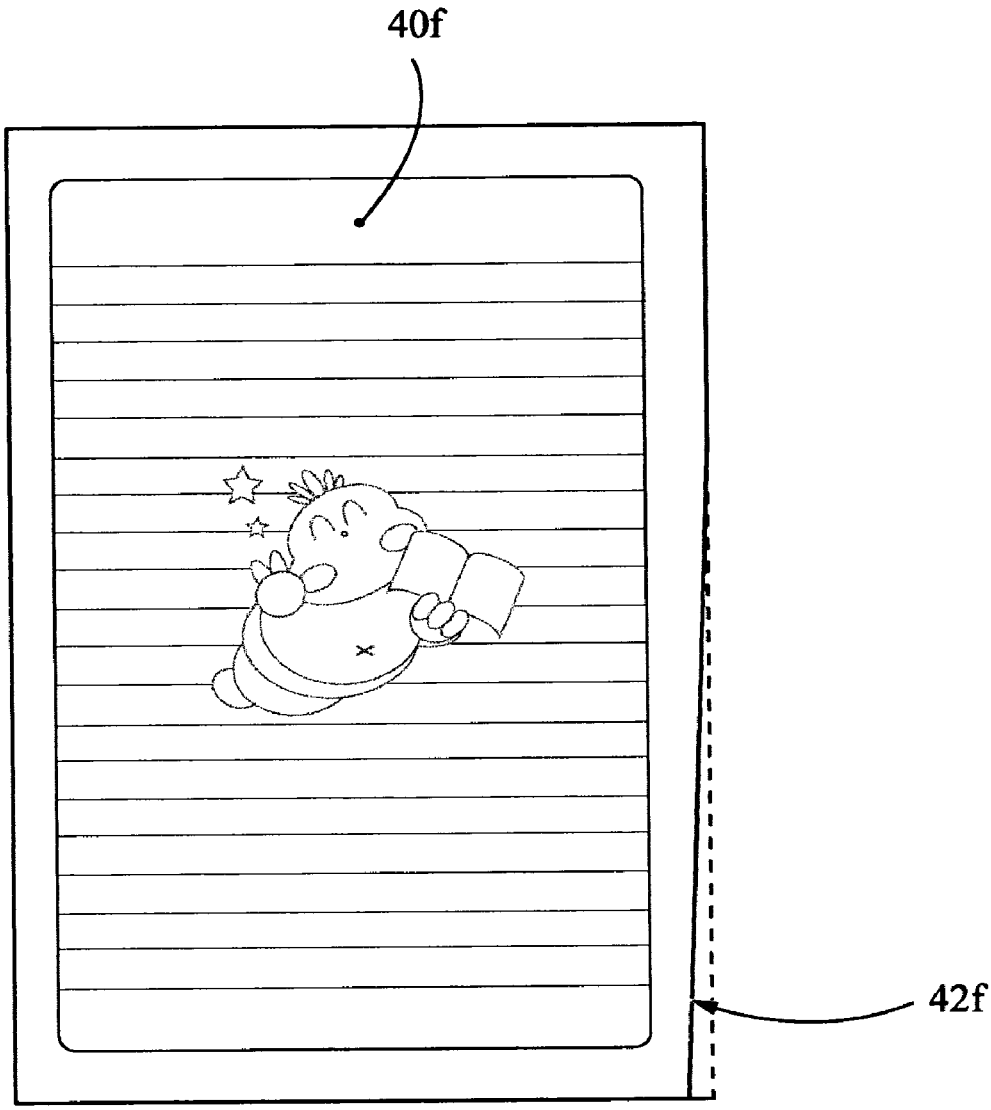
FIG. 8 is a plan view of the Front side of Type D sheet with designations for the front side and cutout part.
Figure 9:
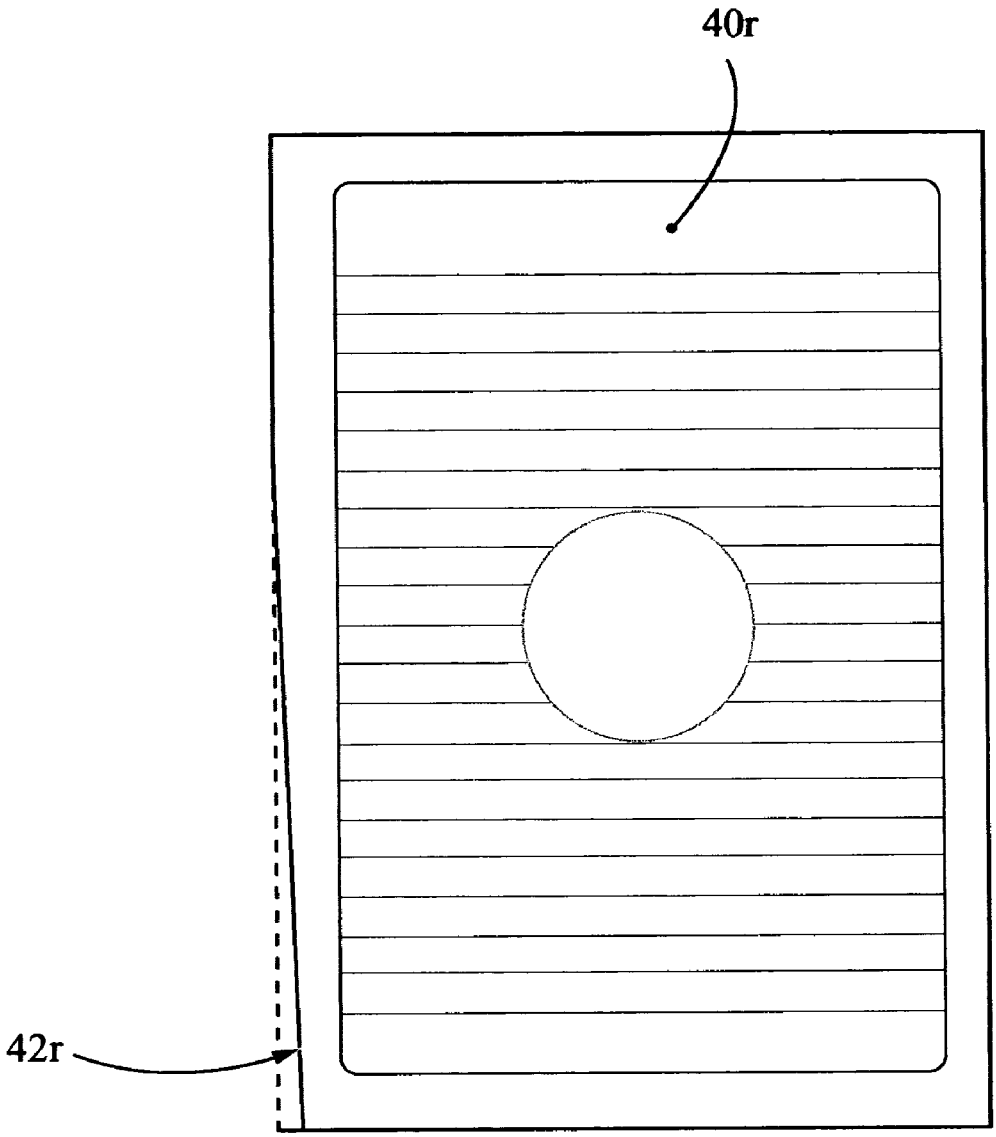
FIG. 9 is a plan view of the Rear side of Type D sheet with designations for the front side and cutout part.

FIG. 2 shows a plan view at the front side of a Type A sheet in the Type A sheet set with a reference numeral, "10*f*" for this entire front surface/side of the sheet and a cutout part, named as "12*f*", along the edge and with the entire length of the sheet. FIG. 3 shows a plan view of the Type A sheet, but this time the rear side of it, with 10*r*, as its designated reference numerals and the cutout part, named as 12*r*. Although, 12*r* is only a mirror image to 12*f* and so as 10*r* to 10*f*, it is essential to call it differently for a clear explanation of the invention. FIG. 4 shows the front side of a Type B sheet in the Type B sheet set with a designated name, 20*f* and the total two cutout parts, both named as 22*f*. FIG. 5 shows the rear side of a Type B sheet with a designated name, 20*r* and the total two cutout parts, both named as 22*r*. FIG. 6 shows the front side of a Type C sheet in the Type C sheet set with a designated name, 30*f* and the one angled cutout part at the upper right corner, labeled 32*f*. FIG. 7 shows the rear side of Type C sheet with a designated name, 30*r* and the cutout part, labeled 32*r*. FIG. 8 shows the front side of a Type D sheet in the Type D sheet set with a designated name, 40*f* and the one angled cutout part at upper right corner, labeled 42*f*. FIG. 9 shows the rear side of Type D sheet with a designated name, 40*r* and the cutout part, labeled 42*r*.

Figure 10:
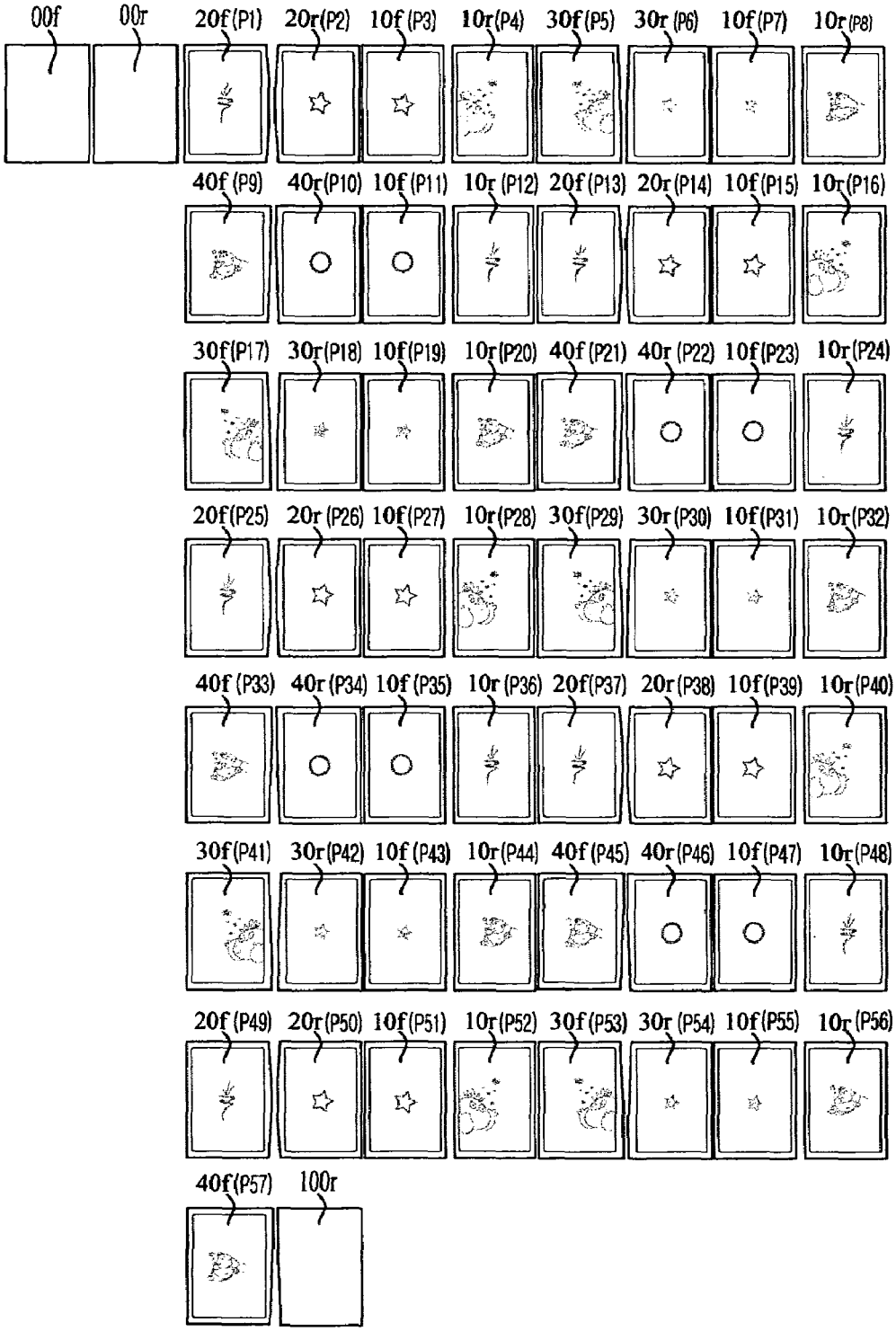
FIG. 10 is a plan view made of all plan views of the composing pages arrayed by the page order.

Along with the different cutouts, 10*f*, 10*r*, 20*f*, 20*r*, 30*f*, 30*r*, 40*f*, and 40*r* carry images of characterized animals or other graphic elements, which are different from each other, in addition to the typical notebook row lines appearing at all types of the inner sheets. However, In FIG. 2, 10*f* illustrates no graphics but the typical row lines for a notebook. This is because the images of the characterized animals or the graphic elements of 10*f* change by the location of 10*f* among the entire inner sheets of the book. The graphics of 10*f* matches whatever characterized animals or the graphic elements the adjacent page has. As a result, FIG. 10 illustrates the characterized animals or the graphic elements printed on 10*f* are all different as 10*f* becomes each different pages of the invention. FIG. 3 and FIG. 10 illustrate that 10*r* has the same variance of the graphics as 10*f*. FIG. 4, FIG. 5, FIG. 6, FIG. 7, FIG. 8, and FIG. 9 all illustrate that 20*f*, 20*r*, 30*f*, 30*r*, 40*f*, and 40*r* carry only one kind of the image of either characterized animals or graphic elements different from each other, along with the typical row lines.

The invention arranges multiple sheets of each different related type—Type A, Type B, Type C, and Type D sheet by an order as shown in FIG. 10. Beginning from the Front Cover sheet (00*f*, 00*r*; each consecutively represents Front Side and Rear Side), follow Type B (20*f*, 20*r*), Type A (10*f*, 10*r*), Type C (30*f*, 30*r*), Type A (10*f*, 10*r*), Type D (40*f*, 40*r*), Type A (10*f*, 10*r*), Type B (20*f*, 20*r*), Type A (10*f*, 10*r*), Type C (30*f*, 30*r*), Type A (10*f*, 10*r*), Type D (40*f*, 40*r*), Type A (10*f*, 10*r*), Type B (20*f*, 20*r*), Type A (10*f*, 10*r*), Type C (30*f*, 30*r*), Type A (10*f*, 10*r*), Type D (40*f*, 40*r*), Type A (10*f*, 10*r*), Type B (20*f*, 20*r*), Type A (10*f*, 10*r*), Type C (30*f*, 30*r*), Type A (10*f*, 10*r*), Type D (40*f*, 40*r*), Type A (10*f*, 10*r*), Type B (20*f*, 20*r*), Type A (10*f*, 10*r*), Type C (30*f*, 30*r*), Type A (10*f*, 10*r*), 40*f* and 100*r* which is a bottom side of rear cover sheet. In FIG. 10, each reference numeral for each side of sheet type is paired with actual page number enclosed in parenthesis. As an example, "40*r*(P10)" represents side 40*r* while existing as page 10 in bookbinding order.

The present invention's 30 sheet contents are composed of 1½ sheets of cover and 28½ sheets of inner/intermediate sheets, which are comprised of 14 sheets of Type A, 5 sheets of Type B, 5 sheets of Type C, and 4½ sheets of Type D sheets. These sheets are all sorted as described in the upper paragraph, and finally bound together to become the whole book of the present invention.

Figure 11:
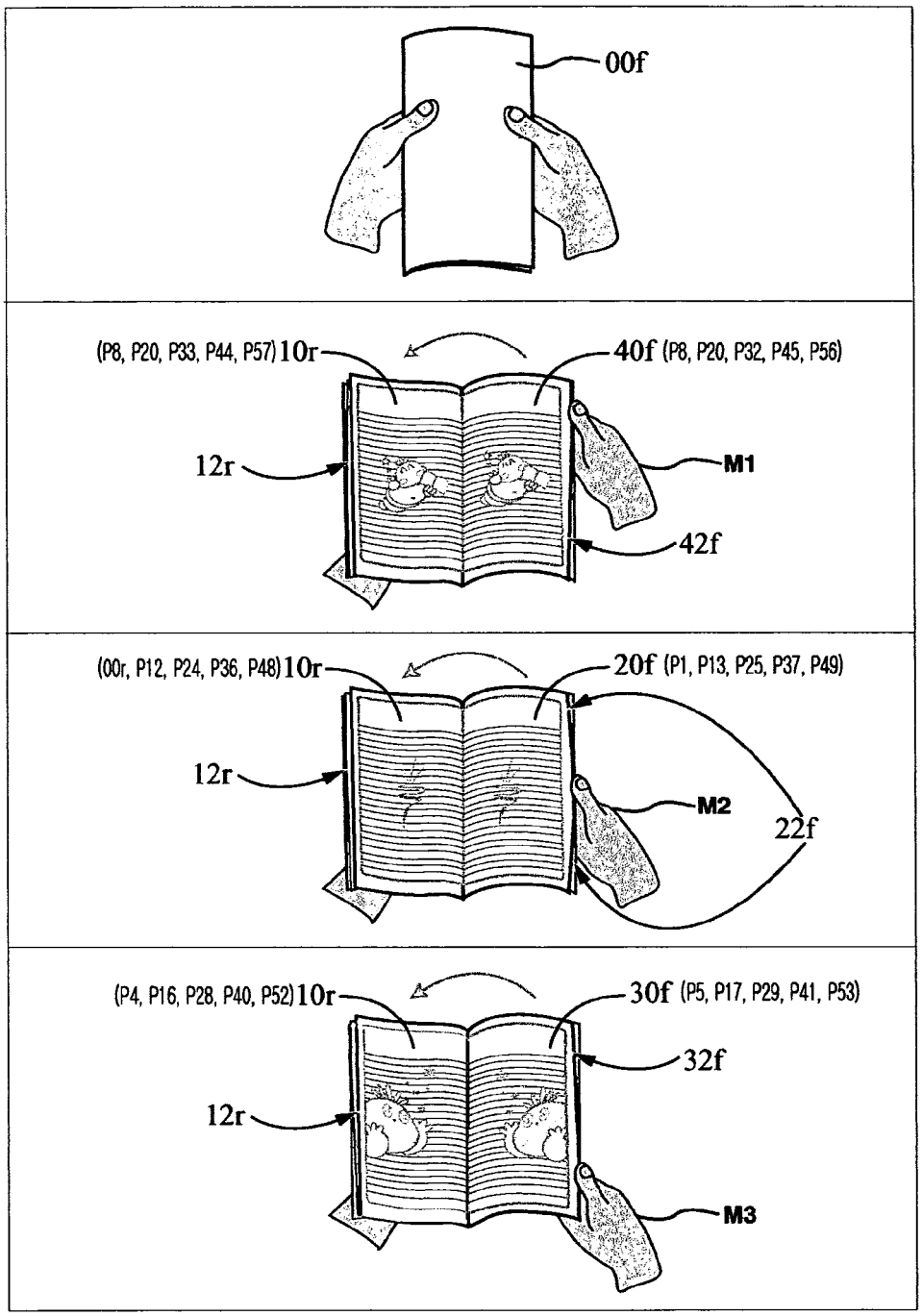
FIG. 11 is default flipping diagrams with corresponding sheet types and page numbers.

FIG. 11 illustrates how the invention achieves the desired goal when the invention is used by flipping in the direction from the front cover (00*f*, 00*r*) to the rear cover (100*r*). M1, M2, and M3 define the action of the thumb and the remaining fingers in the hand used to quickly flip the sheets of the invention, while the other hand is firmly holding the bound edge of the invention. M1 represents the flipping action described above as applied at one engagement location on the peripheral edge at the upper edge of the book. M2 represents the flipping action described above as applied at another different engagement location on the peripheral edge at the middle edge of the book. M3 represents the flipping action described above as applied at another different engagement location on the peripheral edge at the lower edge of the book. Following the illustrations in FIG. 11, when three different actions, which are M1, M2 and M3, are applied at the invention, the invention displays only multiples of three different sets of specific non-continuous pages each carrying the specific same characterized animal. As an example, at the area three fourths from the top in FIG. 11, M2 is applied to the invention. When the fingers of the operating hand continuously grip the book at the middle engagement location and flip the sheets at the middle area, the finger catches only the front surfaces of the underlying sheets with intact edges/engagement portions at the middle engagement location as the pages with cutout edges slip away as described above. In other words, the sheets in each sheet set have front surfaces with engagement portions thereon at one of the engagement locations that are serially engaged to serially expose the front surfaces in that sheet set by continuously gripping the book at the one engagement location and flipping the plurality of sheets from front to back without engaging the front surfaces of sheets between the sheets in other than that sheet set. The sheet sets are all configured in this manner so that the front surfaces of the sheets in the different sheet sets can be similarly serially exposed by continuously gripping the book at the different engagement locations and flipping the sheets from front to back. As a result, at the right side page, only 20*f* (Type B Sheet) appears as page number P1, P13, P25, P37 and P49, illustrated as "20*f* (P1, P13, P25, P37, P49)", while at the left side page, only 10*r* (Type A Sheet) appears as page number 00*r*, P12, P24, P36, and P48, illustrated as "(00*r*, P12, P24, P36, P48) 10*r*". All of the pages at the left side and right side carry the same image of a specific characterized animal. That is, the back/rear surfaces of sheets that directly overlie the front surfaces of the sheets in a particular set have the same type of material thereon so that as the sheets in a particular sheet set are exposed through the flipping action, the same type of related material is simultaneously exposed to view on the front surfaces of the sheets in that set and the back/rear surfaces of the sheets directly overlying the sheets in that set.

Figure 12:
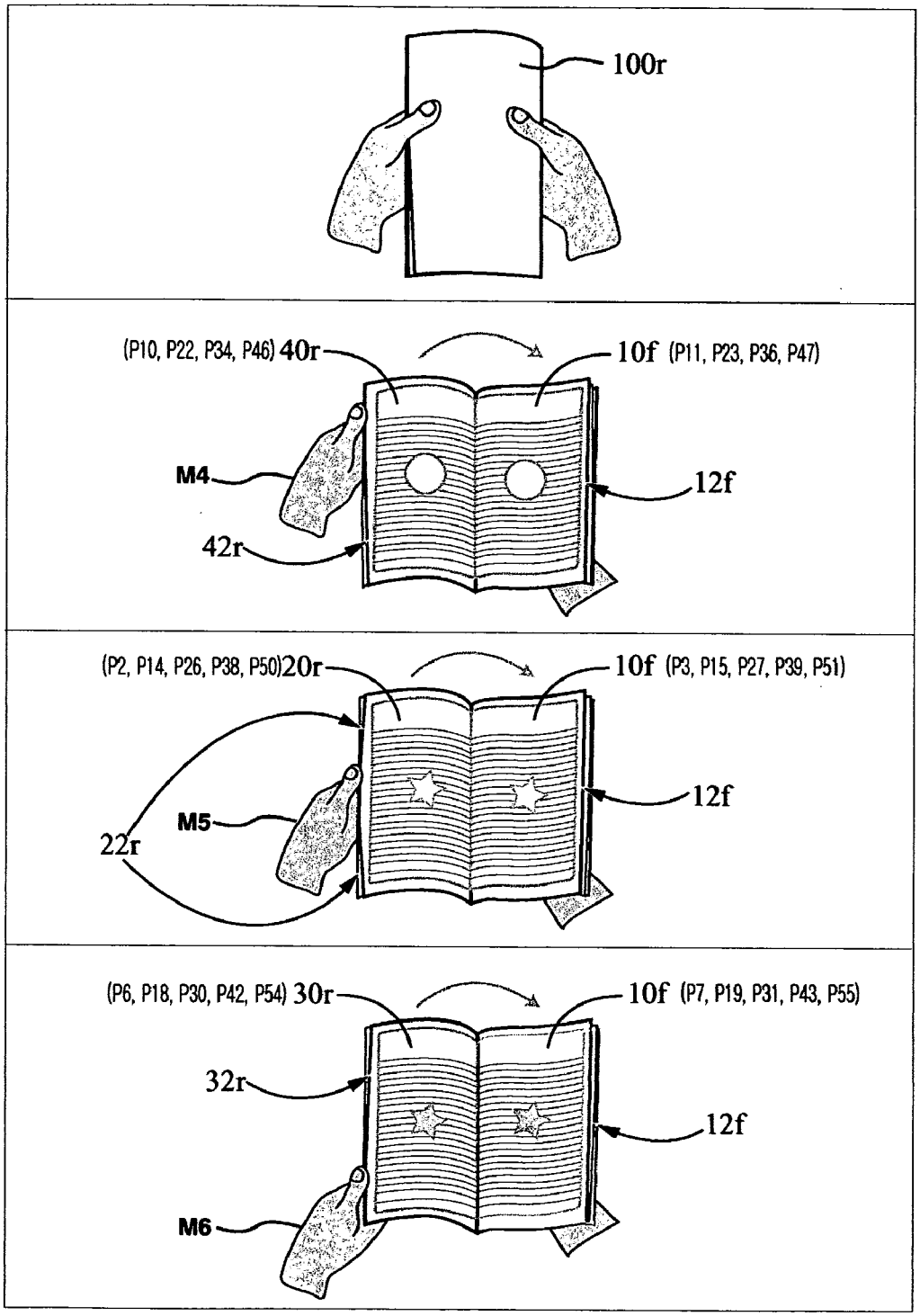
FIG. 12 is reverse flipping diagrams with corresponding sheet types and page numbers.

FIG. 12 illustrates how the invention achieves the desired goal when the invention is used in the direction from the rear bottom cover (100*r*) to the front cover (00*f*, 00*r*). Essentially, the same operation of the book occurs by flipping from rear to front by continuously gripping the book at any of, in this case three (3), different engagement locations and flipping from back/rear to front. M4, M5, and M6 define the action of the thumb and the remaining fingers in the hand used to quickly flip the sheets of the invention, while the other hand is firmly holding the bound edge of the invention. M4 represents the flipping action described above as applied to the engagement location at the upper edge of the invention book. M5 represents the flipping action described above as applied at the engagement location at the middle edge of the book. M6 represents the flipping action described above as applied at the engagement location at the lower edge of the invention book. Following the illustrations in FIG. 12, when three different actions, which are M4, M5 and M6, are applied to the invention, the invention shows only multiples of specific non-continuous pages carrying the specific same graphic elements. As an example, at the area three fourths from the top in FIG. 12, M5 is applied to the invention. When the fingers of the operating hand flip the middle area of the edge, the finger catches only the back surfaces of the overlying sheets with intact edges/engagement portions as the pages with cutout edges slip away as described above. As a result, at the right side page, only 10*f* (Type A Sheet) is engaged and appears serially as page number P3, P15, P27, P39 and P51, illustrated as "10*f*(P3, P15, P27, P39, P51)", while at the left side page, only 20*r* (Type B Sheet) is engaged and appears serially as page number P2, P14, P26, P38, and P50, illustrated as "(P2, P14, P26, P38, P50)20*r*". All of the pages at the left side and right side carry the same type of material/image of the specific graphic elements so that the same type of material can be viewed simultaneously on exposed front and rear surfaces in the same manner as when flipping from front to rear.

Having described my invention, what I claim as my invention is:

1. A book comprising:

a plurality of sheets each having oppositely facing front and rear surfaces, the plurality of sheets comprising a plurality of sheet sets, the book having a peripheral edge, the peripheral edge having a first engagement location and a second engagement location that is different than the first engagement location; and a binding that maintains the plurality of sheets together in a stacked arrangement with a top sheet and a bottom sheet, the plurality of sheets comprising: a) a first sheet set within which each sheet has a front surface having one type of related material thereon; b) a second sheet set within which each sheet has a front surface having another type of related material thereon that is different than the one type of related material; c) at least one sheet in the second sheet set between sheets in the first sheet set; and d) at least one sheet in the first sheet set between sheets in the second sheet set, the front surfaces of the sheets in the first sheet set overlying at least one sheet in the second sheet set each having a first engagement portion comprising a forwardly facing surface at the first engagement location, the sheets in the second sheet set underlying at least one sheet in the first sheet set each having a cutout at the first engagement location underlying one of the forwardly facing surfaces so that the forwardly facing surface on each sheet in the first sheet set overlying a sheet in the second sheet set blocks a cutout in an underlying sheet in the second sheet set at the first engagement location as viewed from the front of the book, so that the first engagement portions are serially engaged by a user's thumb at the first engagement location and exposed by continuously gripping the book at the first engagement location with a rear surface on a user's thumb at the first engagement location and flipping the plurality of sheets from front to back so that the rear surface of the user's thumb passes through the cutouts without engaging the front surfaces of the sheets in the second sheet set underlying at least one sheet in the first sheet set, thereby serially engaging the forwardly facing surfaces and thereby serially exposing the front surfaces of the sheets in the first sheet set without engaging the sheets in the second sheet set underlying at least one sheet in the first sheet set and thereby exposing the front surfaces of the sheets in the second sheet set underlying at least one sheet in the first sheet set, the front surfaces of the sheets in the second sheet set overlying at least one sheet in the first sheet set each having a second engagement portion comprising a forwardly facing surface at the second engagement location, the sheets in the first sheet set underlying at least one sheet in the second sheet set each having a cutout at the second engagement location underlying one of the forwardly facing surfaces so that the forwardly facing surface on each sheet in the second sheet set overlying a sheet in the first sheet set blocks a cutout in an underlying sheet in the first sheet set at the second engagement location as viewed from the front of the book, so that the second engagement portions are serially engaged by a user's thumb at the second engagement location and exposed by continuously gripping the book at the second engagement location with a rear surface on a user's thumb at the second engagement location and flipping the plurality of sheets from front to back so that the rear surface on a user's thumb passes through the cutouts in the sheets in the first sheet set without engaging the front surfaces of sheets in the first sheet set underlying at least one sheet in the second sheet set, thereby serially engaging the forwardly facing surfaces and thereby exposing the front surfaces of the sheets in the second sheet set without engaging the sheets in the first sheet set underlying at least one sheet in the second sheet set and thereby exposing the front surfaces of the sheets in the first sheet set underlying at least one sheet in the second sheet set, the plurality of sheets further comprising a sheet that directly overlies one of the sheets in the first sheet set and has a back surface with the one type of related material thereon that is fully exposed to view simultaneously with the one type of related material on the front surface of the one of the sheets in the first sheet set as the user flips from front to back with the first engagement location continuously grasped by the user.

2. The book according to claim 1 wherein the sheets in the plurality of sheets each has a peripheral edge, the peripheral edges of the sheets in the first sheet set each has a bound peripheral edge portion and an opposite peripheral edge portion, the binding is located at the bound peripheral edge portions of the sheets in the first sheet set, and the book at the opposite peripheral edge portions extends along a first line, as viewed from the front of the book, between a top and bottom of the book.

3. The book according to claim 2 wherein the sheets in the second sheet set have straight edge portions each extending along a second line that is at a slight angle to the first line thereby to define the cutouts in the sheets in the second sheet set between the first and second lines.

4. The book according to claim 2 wherein the opposite peripheral edge portions of sheets in the first sheet set are substantially parallel to the first line and at least a first sheet between the first and second sheets has an opposite peripheral edge portion that is spaced from and substantially parallel to the first line to thereby define one of the cutouts in the first sheet between the opposite peripheral edge portion and the first line.

5. The book according to claim 2 wherein the opposite peripheral edge portion of a first sheet between sheets in the first sheet set extends in a substantially straight second line fully between the top and bottom of the book.

6. The book according to claim 5 wherein the second line is spaced from the first line to thereby define one of the cutouts in the first sheet between the first and second lines.

7. The book according to claim 1 wherein the peripheral edge has a third engagement location and a fourth engagement location that is different than the third engagement location, the plurality of sheets comprises: a) a third sheet set within which each sheet has a rear surface having a third type of related material thereon; b) a fourth sheet set within which each sheet has a rear surface having a fourth type of related material thereon that is different than the third type of related material; c) at least one sheet between sheets in the third sheet set having a rear surface with a type of material that is not the third type of material; and d) at least one sheet between sheets in the fourth sheet set and having a rear surface with a type of material that is not the fourth type of material, the rear surfaces of the sheets in the third sheet set each having a third engagement portion at the third engagement location, the third engagement portions serially engaged at the third engagement location and exposed by continuously gripping the book at the third engagement location and flipping the plurality of sheets from back to front without engaging the rear surface of the at least one sheet between sheets in the third sheet set, thereby serially exposing the back surface of the sheets in the third sheet set without exposing the back surface of the at least one sheet between sheets in the third sheet set.

8. The book according to claim 7 wherein the rear surfaces of the sheets in the fourth sheet set each have a fourth engagement portion at the fourth engagement location, the fourth engagement portions serially engaged at the fourth engagement location and exposed by continuously gripping the book at the fourth engagement location and flipping the plurality of sheets from back to front without engaging the rear surfaces of the at least one sheet between sheets in the fourth sheet set, thereby serially exposing the rear surfaces of the sheets in the fourth sheet set without exposing the rear surfaces of the at least one sheet between sheets in the third sheet set.

9. The book according to claim 8 wherein the plurality of sheets further comprises a sheet that directly underlies one of the sheets in the third sheet set and has a front surface with the third type of related material thereon that is fully exposed to view simultaneously with the third type of related material on the back surface of the one of the sheets in the third sheet set as the user flips from back to front with the third engagement location continuously grasped by the user.

10. The book according to claim 1 wherein the front surfaces of the sheets in the first and second sheets comprises lined notebook surfaces.

11. The book according to claim 10 wherein the one type of related material comprises a first type of graphic image/element and the second type of material comprises a second type of graphic image/element that is different than the first type of graphic image/element.

12. The book according to claim 1 wherein the one type of related material comprises a first type of graphic image/element and the second type of material comprises a second type of graphic image/element that is different than the first type of graphic image/element.

13. The book according to claim 1 wherein only the front surfaces of the sheets in the first sheet set are exposed by gripping the book at the first engagement location and flipping the plurality of sheets fully from the front to the back of the book.

* * * * *